United States Patent [19]

Ogawa et al.

[11] Patent Number: 4,682,080

[45] Date of Patent: Jul. 21, 1987

[54] DISCHARGE LAMP OPERATING DEVICE

[75] Inventors: Soichiro Ogawa; Yoshio Watanabe, both of Tokyo, Japan

[73] Assignee: Hitachi, Ltd., Tokyo, Japan

[21] Appl. No.: 766,197

[22] Filed: Aug. 16, 1985

[30] Foreign Application Priority Data

Aug. 17, 1984 [JP] Japan ..... 59-170414
Aug. 17, 1984 [JP] Japan ..... 59-170415

[51] Int. Cl.[4] ..... H05B 37/02; H05B 39/04; H05B 41/36

[52] U.S. Cl. ..... 315/209 R; 315/225; 315/226; 315/106; 315/DIG. 4; 323/345

[58] Field of Search ..... 315/DIG. 4, DIG. 7, 315/205, 209, 225, 226, 105, 107; 323/263, 345

[56] References Cited

U.S. PATENT DOCUMENTS

| | | | |
|---|---|---|---|
| 4,259,614 | 3/1981 | Kohler | 315/DIG. 7 |
| 4,352,045 | 9/1982 | Widmayer | 315/DIG. 4 |
| 4,371,812 | 2/1983 | Widmayer | 315/DIG. 4 |
| 4,463,286 | 7/1984 | Justice | 315/DIG. 4 |
| 4,529,913 | 7/1985 | Brosillon | 315/DIG. 4 |
| 4,544,862 | 10/1985 | Yamazaki et al. | 315/DIG. 7 |
| 4,583,026 | 4/1986 | Kajiwara et al. | 315/DIG. 7 |

FOREIGN PATENT DOCUMENTS

| | | |
|---|---|---|
| 5835299 | 2/1956 | Japan . |
| 57105996 | 12/1980 | Japan . |

*Primary Examiner*—Saxfield Chatmon
*Attorney, Agent, or Firm*—Antonelli, Terry & Wands

[57] ABSTRACT

A discharge lamp operating device having a high frequency inverter is discharged. Connected to a secondary winding of an oscillation transformer of the high frequency inverter is a discharge current supply circuit having a switch for controlling supply of a discharge current to dim a fluorescent lamp. An electrode heating circuit is connected to secondary windings of the transformer to continuously heat electrodes. An oscillation frequency of the inverter is controlled such that it increases as a dimming factor is high and decreases as the dimming factor is low. A capacitor is connected in series with a path of an electrode heating current in the electrode heating circuit so that the heating current is increased when the dimming factor is high and decreased when it is low by utilizing a frequency dependency of an impedance of the capacitor. As a result, an electrode temperature is kept at an optimum temperature in both start time and dimming time, and the start characteristic and a lifetime of the fluorescent lamp are significantly improved.

16 Claims, 8 Drawing Figures

DISCHARGE LAMP OPERATING DEVICE

BACKGROUND OF THE INVENTION

The present invention relates to a device for operating a discharge lamp by means of a high frequency inverter with a dimming function, and more particularly to a discharge lamp operating device which has an excellent start characteristic and is capable of operating the discharge lamp with a sufficiently long life.

When a liquid crystal display panel is used as a display panel of an automobile, the light source thereof is required to have a sufficient luminance and low power consumption. In order to keep an optimum luminance to prevent fatigue of a driver when he or she drives a car in a bright daytime and a night time, the luminance of the light source must be switched in at least two steps, for example, 50% and 100%. Bearing in mind the fact that the optimum luminance varies from driver to driver, it is desirable that the illumination can be finely variable or dimmed between 0% and 50%.

A discharge lamp such as a fluorescent lamp can provide a sufficient luminance with a low power consumption.

In a common method for dimming the discharge lamp such as fluorescent lamp, a single fluorescent lamp is used, and a switch is inserted in series with the primary winding of an oscillation transformer in an operating device and the switch is turned on and off to change the duty factor to increase or decrease the discharge current so that the luminance is controlled. The fluorescent lamp uses an electron emission electrode which has to be heated. The electrode is usually heated by self-heating by the discharge current.

The above method has two problems 1. In a dimming mode, the discharge current decreases and the self-heating decreases and the electrode temperature drops. As a result, electrode spattering by ion impaction increases and the lifetime of the fluorescent lamp is shortened. 2. If the lamp is started or turned on in the dimming mode, the voltage applied to the lamp is zero when the input switch is off. Since the starting of the lamp depends on the applied voltage and the duration thereof, the lamp start characteristic in the dimming mode is lowered, that is, the lamp is hard to start.

In order to resolve the above problem, in Japanese Unexamined Patent Publication No. 57-162295, a preheating circuit is provided and the electrode is heated by only the discharge current when the discharge current is at a rated value, and in the dimming mode, a small electrode heating current is supplied by the preheating circuit during a turn-off period, that is, during an off-period of the input power supply. In this method, the electrode heating current in the dimming mode cannot be increased to a desired level and it is not effective to improve the start characteristic or prevent blackening and shortening of the lifetime of the lamp. Further, the preheating circuit is complex and expensive.

SUMMARY OF THE INVENTION

It is an object of the present invention to provide a discharge lamp operating device which uses a high frequency inverter and can extend the lamp lifetime and has an excellent start characteristic.

It is another object of the present invention to provide a discharge lamp operating device which uses a high frequency inverter and increases or decreases the electrode heating current in accordance with the load of the device, that is, to provide the desired luminance thereof so that a proper electrode temperature is maintained in start, operating and dimming states.

In order to achieve the above objects, in one aspect of the present invention, the discharge lamp operating device having the high frequency inverter has discharge current supply means at the secondary side of a transformer of the high frequency inverter and a switch connected in series with the discharge current supply path. The discharge current is controlled by turning on and off the switch to dim the lamp. Continuously operating electrode heating means is also inserted at the secondary side of the transformer.

In another aspect of the present invention, the discharge lamp operating device having the high frequency inverter includes discharge current supply means having a switch for controlling the supply of the discharge current at the secondary side of the transformer of the inverter, and continuously operating electrode heating means. The inverter oscillates at a high frequency when the luminance is low, and a low frequency when the luminance is high. A capacitor is connected in series with the electrode heating means so that a high heating current is obtained when the luminance is low and a low heating current is obtained when the luminance is high by the utilization of frequency dependency of the impedance of the capacitor.

By dimming the lamp by turning on and off the switch connected to the secondary winding of the oscillation transformer, the following advantages are presented in the electrode heating current and the start characteristic. 1. By providing two electrode heating circuits in the secondary side of the oscillation transformer independently from the lamp operating circuits, the electrode heating circuit is kept activated in the dimming mode. 2. In the dimming mode, the heating of the electrode is started upon the turn-on of the power supply. The electrode heating current can be set to any desired value. Accordingly, the filament can be fully heated. It is more advantageous than a system in which the switch is inserted in the primary winding of the oscillation transformer. When the circuit is started in the dimming mode, the secondary winding output of the oscillation transformer is always present irrespective of the turn-on or turn-off of the switch. Accordingly, the voltage across the secondary winding can be used as a voltage source for a starting aid for the fluorescent lamp. It is more advantageous than the system in which the switch is connected to the primary winding of the oscillation transformer.

DESCRIPTION OF THE PREFERRED EMBODIMENTS

Figure 1:
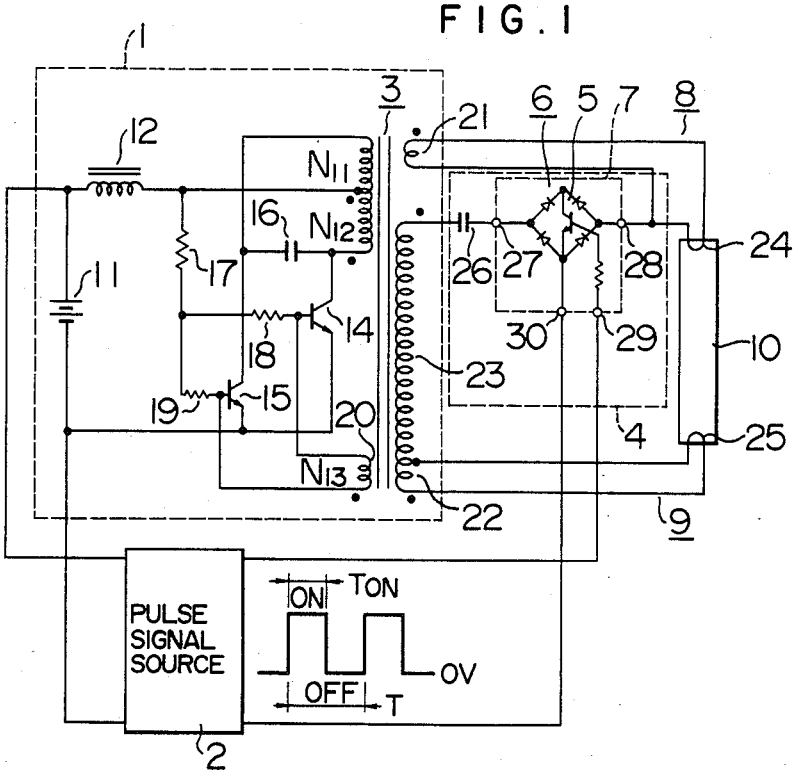
FIG. 1 is a circuit diagram of one embodiment of a fluorescent lamp operating device of the present invention.

One embodiment of the present invention is now explained. FIG. 1 shows a circuit diagram of the fluorescent lamp operating device of the present invention. It comprises a conventional two-transistor self-exciting push-pull inverter 1, a pulse signal source 2 constructed by a variable duty monostable multivibrator, an oscillation transformer 3, a discharge current supply circuit 4 connected to a secondary winding of the oscillation transformer 3, and a switch 7 having a transistor 5 and a diode bridge 6 connected to the circuit 4. When the output of the pulse signal source 2 is high, the transistor 5 is on, that is, the switch 7 is on, and when the output of the pulse signal source is low, the transistor 5 is off, that is, the switch 7 is off. The lamp is dimmed in accordance with the duty factor of the transistor 5.

A preheating current is continuously supplied to a fluorescent lamp 10 by electrode heating circuits 8 and 9 arranged in a secondary circuit of the oscillation transformer 3 irrespective of the on or off state of the switch 7. Accordingly, the temperature of the electrode filaments is kept higher than a predetermined temperature irrespective of the dimming factor of the fluorescent lamp 10. Thus, a fluorescent lamp operating device having a dimming function which prevents blackening of the lamp and assures long lifetime of the lamp is provided.

The circuit of FIG. 1 and the operation thereof are explained in further detail In the inverter 1, a positive terminal of a D.C. power supply 11 is connected to a center tap of a primary winding 13 of the transformer 3 through a choke coil 12, and one end of the primary winding 13 and the other end thereof are connected to a negative terminal of the D.C. power supply 11 through a transistor 14 and through a transistor 15, respectively. A resonance capacitor 16 is connected across the primary winding 13. The base of the transistor 14 is connected to the positive terminal of the D.C. power supply 11 through resistors 17 and 18 and the choke coil 12. The base of the transistor 15 is connected to a junction of the resistors 17 and 18 through a resistor 19. The bases of the transistors 14 and 15 are connected to opposite ends of a secondary winding 20 of the transformer 3 which functions as a feedback winding. The pulse signal source 2 is connected to the D.C. power supply 11 and fed thereby. A secondary winding 21 of the oscillation transformer 3 is connected directly to one electrode filament 24 of the fluorescent lamp 10 and another secondary winding 22 is connected directly to the other electrode filament 25, thereby constituting the electrode heating circuits 8 and 9, respectively. One end of a secondary winding 23 of the transformer 3 is connected to a terminal 27 of the switch 7 through a ballast capacitor 26 which controls the discharge current flowing across the electrode filaments 24 and 25. A terminal 28 of the switch 7 is connected to one end of the electrode filament 24 and the other end of the secondary winding 23 is connected to one end of the electrode filament 25. The base of the transistor 5 in the switch 7 is connected to the output of the pulse signal source 2 through a resistor and a control input terminal 29 of the switch 7, and the emitter of the transistor 5 is connected to a ground output terminal of the pulse signal source 2 through a control input ground terminal 30 of the switch 7.

In operation, upon turn-on of the power supply 11, base currents flow into the transistors 14 and 15 through the resistors 17, 18 and 19. Since the characteristics of those two transistors 14 and 15 are not identical, one of the transistors 14 and 15 first turns on. Assuming that the transistor 14 is turned on earlier, a current flows into a windin $N_{12}$ of the center-tapped primary winding 13 of the transformer 3. Since a resonance circuit is formed by the inductance of the primary winding 13 and capacitance of the capacitor 16, a sine wave voltage is generated across the primary winding 13. A voltage which is determined by the voltage across the primary winding 13 and a ratio of a sum of numbers of turns $N_{11}$ and $N_{12}$ of the primary winding to the number of turns $N_{13}$ of the primary winding 20, is developed across the primary winding 20. Owing to this voltage developed across the winding 20, a negative feedback is applied to the base of the transistor 14 and a positive feedback is applied to the base of the transistor 15, to thereby invert the outputting states of the transistors 14 and 15 such that the transistor 14 is turned off and the transitor 15 is turned on. The above operation is subsequently repeated to maintain the oscillation and voltages are developed across the secondary windings 21, 22 and 23 which voltages are determined by the turn ratios of the respective secondary windings to the primary winding 13. After the turn-on of the D.C. power supply 11, the voltages are always developed across the secondary windings 21 and 22 and the two electrode filaments of the fluorescent lamp 10 are always heated. Since the voltages across the secondary windings 21 and 22 can be set to any desired values by selecting the turn ratios of the primary winding to the secondary windings, the electrode filaments can be kept at an optimum temperature.

The fluorescent lamp is dimmed by actuating the switch 7 inserted in series with the secondary winding 23 of the transformer at a desired duty factor by the pulse signal output from the pulse signal source 2 constructed by, for example, the monostable multivibrator so that effective values of the discharge current between the electrode filaments 24 and 25 are adjusted. The pulse signal source 2 may comprise a clock signal generator and a monostable multivibrator which is triggered by the output of the clock signal generator. Accordingly, the duty factor of the switch 7 can be changed by varying a resistor or a capacitor of the monostable multivibrator. Such technique is well known in the art and is not detailed here. The high frequency inverter is not limited to the push-pull type but the present invention is applicable to any inverter which uses an insulated transformer such as a one-transistor blocking inverter or a one-transistor externally-excited inverter. The capacitor 26 may be replaced by a choke coil.

Figure 2:
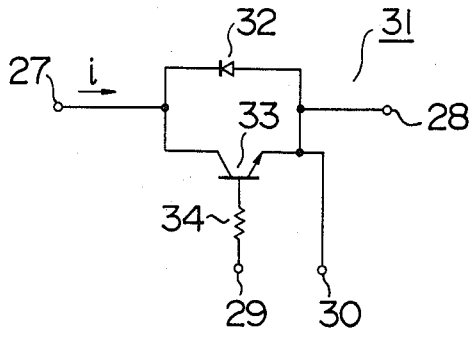
FIGS. 2 and 3 show modification of a switch used in the embodiment of FIG. 1.

FIG. 2 shows a modification of the switch 7 of FIG. 1. Anti-parallelly connected diode 32 and transistor 33 are connected across the terminals 27 and 28. A base of the transistor 33 is connected to the control input terminal 29 through a resistor 34, and an emitter is connected to the terminal 30. When the transistor 33 is on, a discharge current i flows through the transistor 33 when the current i flows in a direction shown, and flows through the diode 32 when the current i flows in the opposite direction. When the transistor 33 is off, the current i in the direction shown is blocked since the transistor 33 is turned off, and when the current i flows in the opposite direction, the current i initially flows into the capacitor 26 as a charging current but after the charging of the capacitor 26 the current i no longer flows through the diode 33. Accordingly, the bidirectional discharge current switching circuit of a simple construction is provided.

Figure 3:
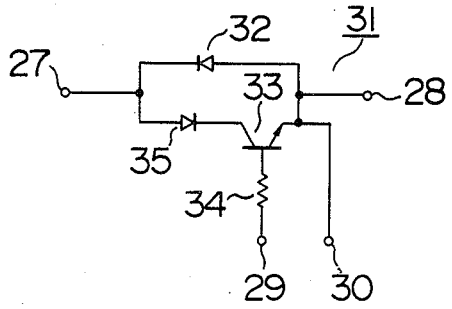

FIG. 3 shows a further modification of the switch shown in FIG. 2. In the switch of FIG. 2, if the frequency is very high (for example, 100 kHz), a perfect off state is not attained because a small current flows through the off-state transistor due to a junction capacitance of the transistor. In the switch of FIG. 3, a diode 35 is connected in series with the collector of the transistor to eliminate the influence by the junction capacitance of the transistor to block the small current.

Figure 4:
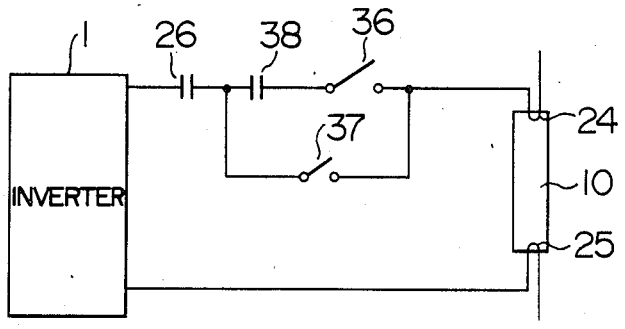
FIG. 4 shows another embodiment of the fluorescent lamp operating device of the present invention.

FIG. 4 shows an embodiment of the present invention which uses a plurality of improved switches shown in FIGS. 2 or 3. Only a main portion is shown in FIG. 4. The ballast capacitor 26 is connected in series with another ballast capacitor 38, one end of a first switch 36 is connected in series with the ballast capacitor 38, one end of a second switch 37 is connected to a junction of the ballast capacitors 26 and 38, and the other ends of the first and second switches 36 and 37 are connected to one end of the electrode filament 24.

In operation:

(1) When the switch 37 is on, only the ballast capacitor 26 is effective and the lamp is lit at a rated level (100%).

(2) When the switch 37 is off and the switch 36 is on, the ballast capacitors 26 and 38 are effective. If the capacitances of the capacitors 26 and 38 are selected such that the lamp is lit at a half of the rated level (50%), the lamp is lit at the 50% level.

(3) When the switch 37 is off and the switch 36 is repeatedly turned on and off, the lamp is dimmed between 0–50% in accordance with the duty factor of the switch 36.

In the present embodiment, the switches shown in FIGS. 2 and 3 are effective when various dimming conditions are desired by combinations of the ballast capacitors and the switches.

Figure 5:
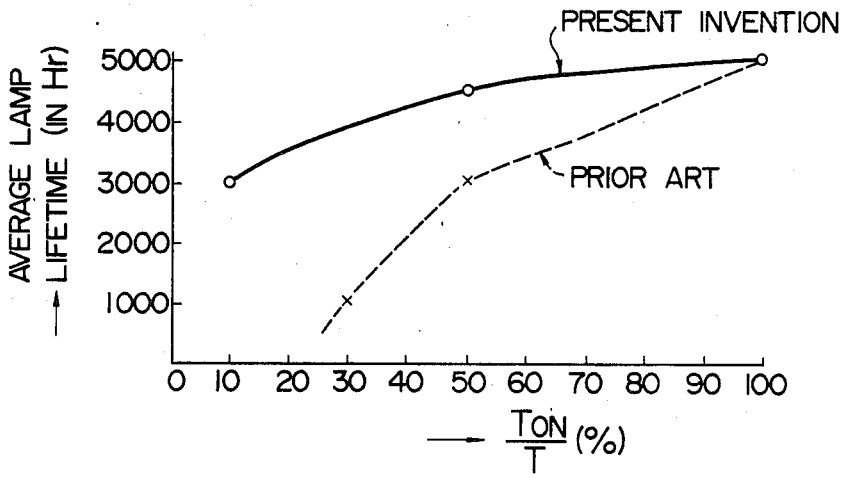
FIG. 5 is a graph showing a relationship between a lamp lifetime and a duty factor (reciprocal of dimming factor) in the present invention and a prior art device.

FIG. 5 shows relationships between the duty factors and the lamp lifetimes in the operating device of the embodiment of FIG. 1 and a prior art device in which the switch is inserted in the primary winding of an oscillation transformer.

Conditions are: power supply 11: DC 12 V, oscillation frequency: 35 kHz, fluorescent lamp: FL 8 W.

As seen from FIG. 5, in the prior art device in which the switch is inserted in the primary winding of the oscillation transformer, the lamp lifetime is shortened with the dimming factor. The lifetime is only 1000 hours when the duty factor is 30%. Accordingly, the prior art device is not practicable when a high dimming factor is required. In the present device, the lifetime is 3000 hours when the duty factor is 10% and the lamp lifetime does not significantly change with the dimming factor and a stable lamp lifetime characteristic is obtained.

Figure 6:
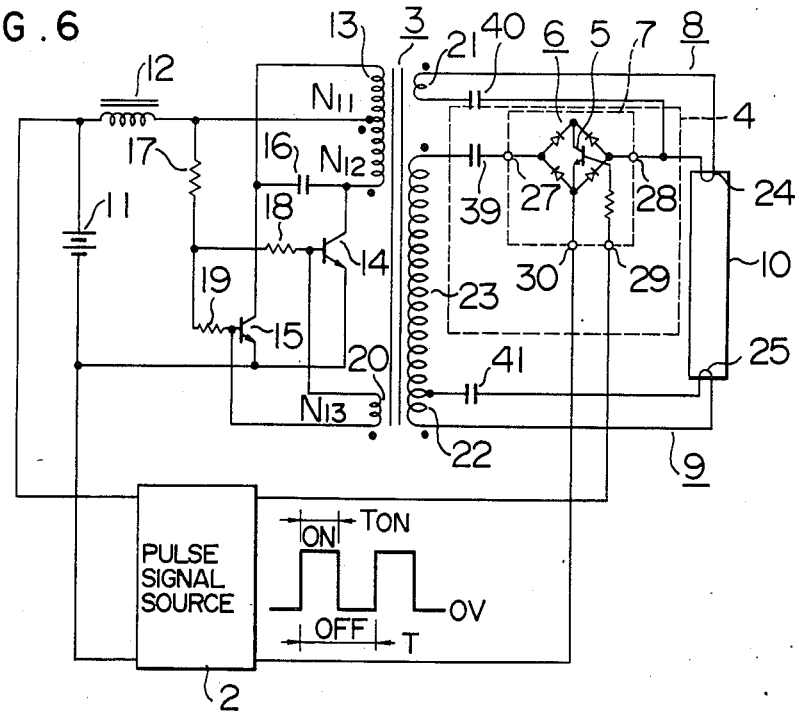
FIG. 6 shows another embodiment of the present invention.

FIG. 6 shows another embodiment of the present invention which is an improvement over the fluorescent lamp operating device of the embodiment of FIG. 1.

In the embodiment of FIG. 1, the lifetime of the fluorescent lamp is significantly extended compared to the prior art device as shown in FIG. 5 but a further improvement of the embodiment of FIG. 1 is possible. In the embodiment of FIG. 1, the constant electrode heating voltage which is determined by the turn ratios of the primary winding 13 and the secondary winding 23 and the voltage developed across the primary winding 13 is supplied to the electrode filaments irrespective of the dimming factor. Accordingly, if the discharge current is at the rated level, the electrodes are heated by a sum of heating by the electrode heating voltage and self-heating by the discharge current. As a result, depending on the selection of the electrode heating voltage, the electrode temperature may rise above an optimum temperature if the discharge current is at or near the rated level, and the lifetime of the fluorescent lamp may be shortened. The embodiment of FIG. 6 resolves the above problem.

The principle of operation of the embodiment of FIG. 6 is first explained. It uses a self-exciting high frequency inverter. An impedance element for controlling a discharge current, for example, a capacitor ($C_L$) is inserted in a secondary circuit of the oscillation transformer of the self-exciting high frequency inverter so that the oscillation frequency is changed between a non-load state and a lamp lighting state. In the non-load state, the oscillation frequency is determined primarily by a parallel resonance of an inductance L of the primary winding of the oscillation transformer and a resonance capacitor ($C_R$) connected in parallel to the primary winding. In the lamp lighting state, the resonance frequency is lowered by the affect of an impedance of the fluorescent lamp and the capacitor ($C_L$) which is the discharge current control impedance. More specifically, in the lamp lighting state, the oscillation frequency is determined by the parallel resonance which is determined by the inductance L of the primary winding, the capacitance of the resonance capacitor ($C_R$) and the capacitance of the discharge current control capacitor ($C_L$) converted to the primary circuit value. As shown in FIG. 6, the switch 7 is inserted in the secondary circuit of the oscillation transformer in series with the discharge current control capacitor 39 and the lamp 10 is dimmed by turning on and off the switch 7. When the switch 7 is on, the oscillation frequency is the frequency in the lamp lighting state, and when the switch 7 is off, the oscillation frequency is the frequency in the non-load status. Accordingly, by changing the duty factor of the switch 7, the average frequency varies with the dimming factor.

A capacitor ($C_H$) is inserted in series with the heating current path of the electrode heating circuit to adjust the heating current in accordance with the dimming factor. Thus, the higher the oscillation frequency is, that is, the higher the dimming factor is, the more is the impedance of $C_H$ decrease and the more does the heating current increases.

As a result, the average oscillation frequency changes with the dimming factor and the effective value of the electrode heating current is decreased as the discharge current increases and increased as the discharge current decreases so that the electrode heating current varies in the reverse relation to the discharge current. Thus, the electrode temperature is kept essentially constant irrespective of the dimming factor. As a result, the dimming factor of the operating device does not affect the lamp lifetime.

In the operating device which uses the externally excited high frequency inverter, a similar effect can be attained by detecting the change of the discharge current and feeding it back to the primary circuit of the oscillation transformer to control the oscillation frequency.

In the embodiment of FIG. 6, the like elements to those shown in FIG. 1 are designated by the like numerals and the explanation thereof is omitted. The high frequency inverter is a self-exciting two-transistor push-pull inverter similar to the inverter 1 of FIG. 1. The primary winding 13 of the oscillation transformer 3 has an inductance L and a capacitor 16 is connected in parallel thereto. The discharge current supply circuit 4 is connected to the secondary windings 21 and 22 of the oscillation transformer 3. A capacitor 39 serves as a discharge current control element, and the switch 7 and the fluorescent lamp 10 are connected in series with the capacitor 39. Two independent heating circuits including capacitors 40 and 41, respectively, as electrode heating current control elements are connected in series with the secondary windings 21 and 22 of the oscillation transformer 3.

The capacitor, on the one hand, has a discharge current control function and is one of the components of the discharge current supply circuit 4, and, on the other hand, has a function to change the oscillation frequency of the inverter 1 in accordance with the change of the discharge current by the switch 7 and it may be considered as one component of the inverter 1.

The switch 7 may be the one shown in FIGS. 2 or 3.

In the present embodiment, the fluorescent lamp 10 is dimmed by turning on and off the switch 7. By changing the duty factor of the switch 7, the dimming factor can be continuously changed.

The oscillation frequency in the dimming mode is determined by the inductance L of the primary winding 13 of the oscillation transformer 3, the capacitor 16, the capacitor 39 in the secondary circuit of the transformer 3 and the lamp impedance when the switch 7 is on, and by the inductance L of the primary winding 13, the capacitor 16 and the capacitors 40 and 41 of the heating circuits 8 and 9 when the switch 7 is off. Accordingly, the average oscillation frequency can be continuously changed with the duty factor of the switch 7.

Figure 7:
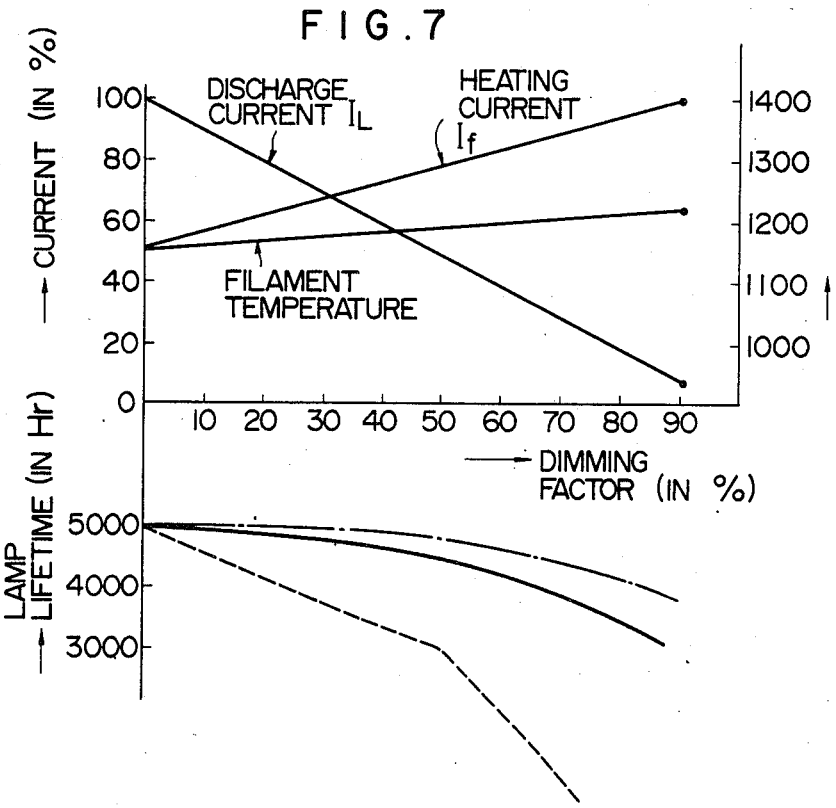
FIG. 7 is a graph showing an advantage of the present invention.

FIG. 7 is a graph which shows a change of a temperature of the electrode filament for the dimming factor of the fluorescent lamp 10 in the circuit of FIG. 6. The ordinate represents a current in percent and the abscissa represents a dimming factor in percent. The lamp (discharge) current decreases with the dimming factor and the oscillation frequency increases with the dimming factor as explained above. Accordingly, the heating currents $I_f$ of the electrode heating circuits 8 and 9 increase with the dimming factor. As a result, the filament temperature does not essentially change and is kept essentially constant.

A lower half portion of FIG. 7 shows a relationship between the lamp lifetime and the dimming factor The ordinate represents the lamp lifetime and the abscissa represents the dimming factor. In FIG. 7, the curves shown in FIG. 5 are also shown on the same coordinate so that comparisons are made among the embodiment of FIG. 1, the prior art device in which the oscillation transformer is switched in the primary circuit and the embodiment of FIG. 6. As seen from FIG. 7, in the embodiment of FIG. 6 (shown by a chain line), the lamp lifetime is 4000 hours when the dimming factor is 90% (turn-on 10%, turn-off 90%). This is a great improvement over the prior art device (shown by a broken line) in which the lifetime is only 100–1000 hours at the same dimming factor. The lamp lifetime in the embodiment of FIG. 6 is improved over that of the embodiment of FIG. 1 (shown by a solid line).

While the push-pull high frequency inverter has been described, the same effect can be obtained for another oscillation system.

In the present embodiment, the electrode temperature is always kept essentially constant irrespective of the dimming factor of the fluorescent lamp and hence the lamp lifetime can be significantly extended.

Figure 8:
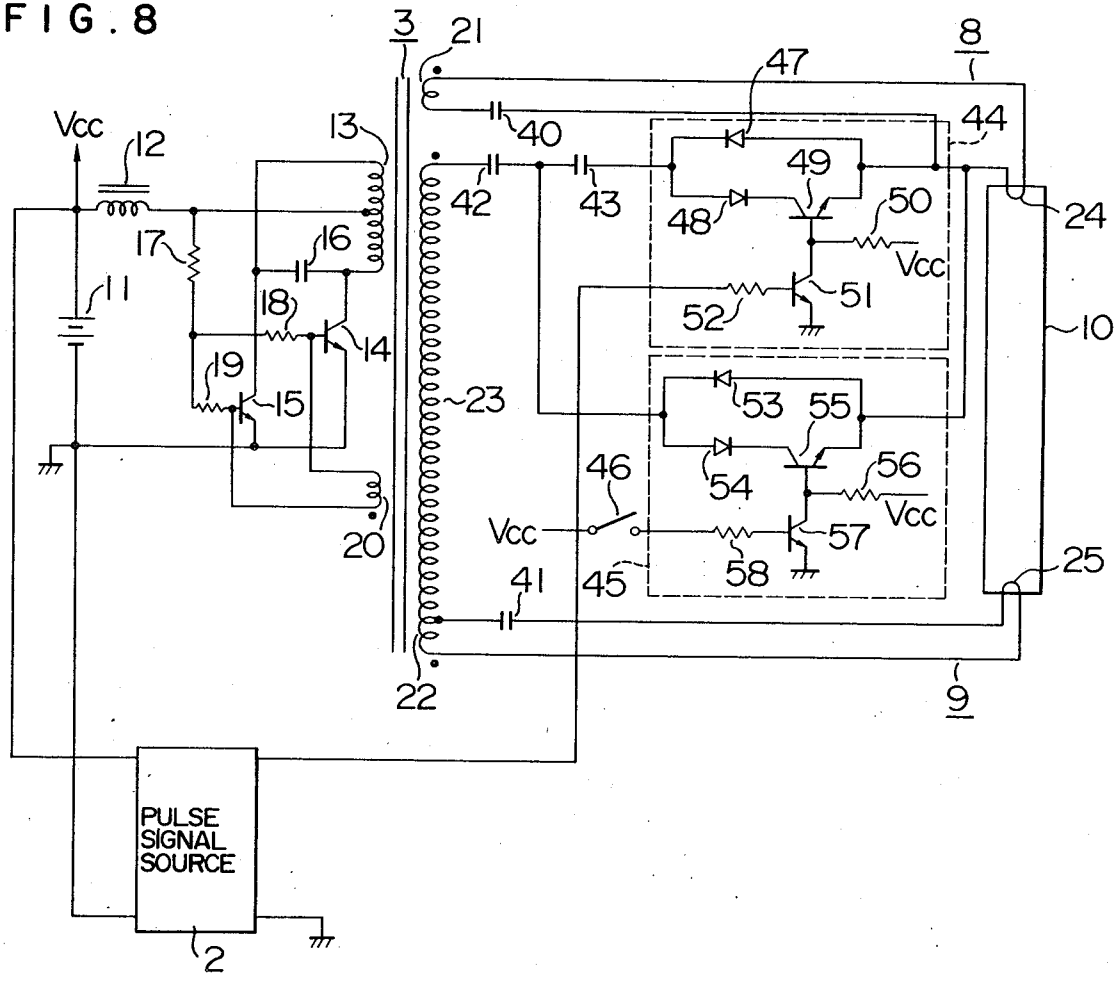
FIG. 8 shows a circuit diagram in which two switches of FIG. 4 are used in the embodiment of FIG. 6.

FIG. 8 shows another embodiment which is similar to the embodiment of FIG. 6 and uses two switches shown in FIG. 3. A specific configuration of the switch shown in FIG. 3 is also shown in FIG. 8. The like elements to those shown in FIG. 6 are designated by like numerals and the explanation thereof is omitted.

The D.C. power supply 11 may be an automobile battery having an output voltage $V_{cc}$ of 12 volts. In order to attain two-step course dimming (for example, 100% and 50%), one end of the seconday winding 23 is connected to one end of a first switch 44 through capacitors 42 and 43, and a junction of the capacitors 42 and 43 is connected to one end of a second switch 45. The other ends of the first and second switches 44 and 45 are connected to one end of the electrode filament 24. A control input of the first switch 44 is connected to an output of the pulse signal source 2. A control input of the second switch 45 is connected to a positive terminal of the D.C. power supply 11 through a switch 46, which may be linked to a lamp switch of the automobile. A cathode of a diode 47 is connected to the capacitor 43 and an anode thereof is connected to one end of the electrode filament 24. Connected across the diode 47 is a series connection of a diode 48 and a transistor 49 with the diode 48 having an anode thereof connected to a cathode of the diode 47 and the transistor 49 having a collector thereof connected to a cathode of the diode 48 and an emitter thereof connected to an anode of the diode 47. A base of the transistor 49 is connected to one end of a resistor 50 and a collector of a transistor 51. The voltage $V_{cc}$ is supplied to the other end of the resistor 50. An emitter of the transistor 51 is grounded and a base thereof is connected to the output of the pulse signal source 2 through a resistor 52. The diodes 47 and 48, transistors 49 and 51 and resistors 50 and 52 form the first switch 44. A diode 53 has a cathode thereof connected to a junction of the capacitors 42 and 43, and an anode thereof connected to the end of the electrode filament 24. Connected across the diode 53 is a series connection of a diode 54 and a transistor 55 with the diode 54 having an anode thereof connected to the cathode of the diode 53 and the transistor 55 having an emitter thereof connected to an anode of the diode 53. A base of the transistor 55 is connected to one end of a resistor 56 and a collector of a transistor 57. The voltage $V_{cc}$ is supplied to the other end of the resistor 56. An emitter of the transistor 57 is grounded and a base thereof is connected to one end of a switch 46 through a resistor 58. The voltage $V_{cc}$ is supplied to the other end of the switch 46. The diodes 53 and 54, transistors 55 and 57 and resistors 56 and 58 form the second switch 45.

In operation, assuming that the switch 46 is off, the transistor 57 is off and a base current flows into the base of the transistor 55 through the resistor 56. Thus, the second switch 45 is always kept on and only the ballast capacitor 42 is effective irrespective of the first switch 44 being turn-on or turn-off. Thus, the lamp is lit at the rated level (100%).

When the switch 46 is on and the duty factor of the pulse output signal of the pulse signal source 2 is 0% (i.e. continuously low), the first switch 44 is now on since the transistor 51 is off and therefore the transistor 49 is on. The second switch 45 is always kept off. Accordingly, by selecting the capacitances of the capacitors 42 and 43, the lamp can be lit at one-half (50%) of the rated level.

When the switch 46 is on and the second switch is off, the dimming factor can be continuously changed between 0% and 50% by changing the duty factor of the pulse output signal of the pulse signal source 2.

As described hereinabove, in accordance with the discharge lamp operating device of the present invention, the discharge lamp such as fluorescent lamp can be lit with a high reliability, enjoy a long lifetime and an excellent starting characteristic.

While this invention has been described with reference to illustrative embodiments, this description is not intended to be construed in a limiting sense. Various modifications to the illustrative embodiments, as well as other embodiments of the invention, will be apparent to persons skilled in the art upon reference to this description. It is therefore contemplated that the appended claims will cover any such modifications or embodiments as fall within the true scope of the invention.

We claim:

1. A discharge lamp operating apparatus having a dimming function comprising:

an inverter having first secondary windings to be connected to electrodes of a discharge lamp for supplying currents continuously to heat said electrodes and a second secondary winding to be connected to said electrodes for causing a discharge current to flow between said electrodes;

discharge current supply means connected between said second secondary winding and said electrodes for supplying said discharge current, including switching means connected to said second secondary winding for controlling the supply of the discharge current to said electrodes at a duty factor determined by a desired dimming factor, and a capacitor connected in series with said second secondary winding and said switching means, and said switching means being formed by an anti-parallel connection of a first diode and a transistor.

2. A discharge lamp operating device according to claim 1 wherein said switching means further includes a second diode connected between a collector of said transistor and a junction of said collector and said first diode.

3. A discharge lamp operating apparatus having a dimming function comprising:

an inverter having first secondary windings for supplying currents to heat electrodes of a discharge lamp, and second secondary winding for causing a discharge current to flow between said electrodes;

discharge current supply means connected to said electrodes for supplying said discharge current, including first switching means for controlling the supply of said discharge current to said electrodes at a duty factor determined by a desired dimming factor and a first capacitor connected in series with said second secondary winding; and electrode heating means connected to said electrodes for continuously supplying said electrode heating current to said electrodes from the outputs of said first secondary windings, said inverter including means for changing an oscillation frequency thereof in accordance with increase or decrease of said discharge current due to a change of the duty factor, and said electrode heating means including heating current control means connected to said first secondary windings for controlling said heating current such that the heating current decrease or increases as said discharge current increases or decreases, respectively; and wherein said switching means is formed by an anti-parallel connection of a first diode and a series circuit formed of a second diode and a first transistor.

4. A discharge lamp operating device according to claim 3 further comprising a series circuit connected across said first switching means, said series circuit consisting of a second capacitor and second switching means connected in series, said first and second switching means being independently controlled.

5. A discharge lamp operating device according to claim 4 wherein said second switching means is formed by an anti-parallel connection of a third diode and a series connection of a fourth diode and a second transistor.

6. A discharge lamp operating device according to claim 3 further comprising means having an output thereof connected to a base of said first transistor for producing a signal of a constant oscillation period and a variable pulse width, said switching means being actuated at a variable duty factor by said signal.

7. A discharge lamp operating device according to claim 3, wherein said heating current control means includes second capacitors each having one end thereof connected to said first winding and the other end thereof connected to said electrodes.

8. A discharge lamp operating apparatus having a dimming function comprising:

an inverter having first secondary windings for supplying currents to heat electrodes of a discharge lamp, and a second secondary winding for causing a discharge current to flow between said electrodes;

discharge current supply means connected to said electrodes for supplying said discharge current, including first switching means for controlling the supply of said discharge current to said electrodes at a duty factor determined by a desired dimming factor; and electrode heating means connected to said electrodes for continuously supplying said electrode heating current to said electrodes from the outputs of said first secondary windings;

said inverter including an oscillation transformer having a primary winding, said first and second secondary windings and a feedback winding, a first capacitor connected in parallel to said primary winding, drive means controlled by an output of said feedback winding for continuously driving a resonance circuit formed by said primary winding and said first capacitor, and a second capacitor connected between said second secondary winding and said switching means, said heating current control means including a pair of third capacitors each having one end thereof connected to said first winding and the other end thereof connected to a respective one of said electrodes, an oscillation frequency of said inverter changing in accordance with increase or decrease of the discharge current due to a change of the duty factor, and said heating current decreasing or increasing as said discharge current increases or decreases, respectively;

said first switching means being formed by an anti-parallel connection of a first diode and a series circuit including a second diode and a first transistor.

9. A discharge lamp operating device according to claim 8 further comprising a series circuit connected across said first switching means, said series consisting of a fourth capacitor and second switching means connected in series, said first and second switching means being independently controlled.

10. A discharge lamp operating device according to claim 9 wherein said second switching means is formed by an anti-parallel connection of a third diode and a series connection of a fourth diode and a second transistor.

11. A discharge lamp operating device according to claim 8 further comprising means having an output thereof connected to a base of said first transistor for producing a signal of a constant oscillation period and a variable pulse width, said switching means being actuated at a variable duty factor by said signal.

12. A discharge lamp operating apparatus having a dimming function comprising:

an inverter having first secondary windings to be connected to electrodes of a discharge lamp for supplying currents to continuously heat said electrodes and a second secondary winding for causing a discharge current to flow between said electrodes;

discharge current supply means to be connected to said electrodes, for receiving said discharge current and supplying said discharge current to said electrodes, including first switching means connected to said second secondary winding for controlling the supply of said discharge current to said electrodes at a duty factor determined by a desired dimming factor and a first capacitor connected in series with said second secondary winding, said first switching means being formed by an anti-parallel connection of a first diode and a series circuit including a second diode and a first transistor; and a pair of second capacitors each connected in series with respective ones of said first secondary windings.

13. A discharge lamp operating device according to claim 12 further comprising a series circuit connected across said first switching means, said series circuit being formed of a third capacitor and second switching means connected in series, said first and second switching means being independently controlled.

14. A discharge lamp operating device according to claim 13 wherein said second switching means includes an anti-parallel connection of a third diode and a series circuit including a fourth diode and a second transistor.

15. A discharge lamp operating device according to claim 12 further comprising means having an output thereof connected to a base of said first transistor for producing a signal of a constant oscillation period and a variable pulse width, said switching means being actuated at a variable duty factor by said signal.

16. A discharge lamp operating device according to claim 12 wherein said inverter includes an oscillation transformer having a primary winding, said first and second secondary windings and a feedback winding, a third capacitor connected in parallel to said primary winding, drive means controlled by an output of said feedback winding for continuously driving a resonance circuit formed by said primary winding and a fourth capacitor.

* * * * *